US009920546B2

(12) United States Patent
van der Meijden et al.

(10) Patent No.: US 9,920,546 B2
(45) Date of Patent: Mar. 20, 2018

(54) COMPONENTS OF AUTOMATIC POOL CLEANERS

(71) Applicant: ZODIAC POOL SYSTEMS, INC., Vista, CA (US)

(72) Inventors: Hendrikus Johannes van der Meijden, Glen Austin (ZA); Bruce Harbottle, Gauteng (ZA)

(73) Assignee: Zodiac Pool Systems LLC, Vista, CA (US)

( * ) Notice: Subject to any disclaimer, the term of this patent is extended or adjusted under 35 U.S.C. 154(b) by 259 days.

(21) Appl. No.: 14/711,499

(22) Filed: May 13, 2015

(65) Prior Publication Data

US 2016/0333600 A1 Nov. 17, 2016

(51) Int. Cl.
*E04H 4/16* (2006.01)

(52) U.S. Cl.
CPC ..... *E04H 4/1654* (2013.01); *E04H 4/1636* (2013.01)

(58) Field of Classification Search
CPC ..... E04H 4/16; E04H 4/1636; E04H 4/1654; B63B 59/08
USPC ..... 15/186–188, 1.7, 179–180
See application file for complete search history.

(56) References Cited

U.S. PATENT DOCUMENTS 3,324,492 A 6/1967 Myers et al.
3,398,422 A * 8/1968 Barry ..... A47L 11/325 15/117
4,052,950 A * 10/1977 Hirata ..... B63B 59/10 114/222
4,137,590 A * 2/1979 Brown ..... A47L 11/164 15/180
D271,816 S 12/1983 Price
4,498,206 A * 2/1985 Braukmann ..... E04H 4/1636 15/1.7
5,029,361 A * 7/1991 Murata ..... A47L 9/0416 15/141.2
D358,235 S 5/1995 Brooks et al.
D373,230 S 8/1996 Sebor et al.
D408,104 S 4/1999 Adam
5,947,051 A 9/1999 Geiger
D430,960 S 9/2000 Van Der et al.
D529,669 S 10/2006 Blanc-tailleur
D580,260 S 11/2008 Collins et al.
(Continued)

FOREIGN PATENT DOCUMENTS

DE 3535213 4/1986
EP 2706170 3/2014
(Continued)

OTHER PUBLICATIONS

Design U.S. Appl. No. 29/550,982, Notice of Allowance, dated Apr. 17, 2017, 6 pages.
(Continued)

*Primary Examiner* — Laura C Guidotti
(74) *Attorney, Agent, or Firm* — Kilpatrick Townsend & Stockton LLP; Dean W. Russell

(57) ABSTRACT

Components of automatic pool cleaners (APCs) are detailed. The components may include brushes configured to attach to blades of scrubbers of the APCs. The flexible brushes may rotate as their associated blades rotate and have fingers which flex so as to adduce contact between a to-be-cleaned pool or spa surface and bristles protruding outward from sides of the fingers.

11 Claims, 6 Drawing Sheets

(56) References Cited

U.S. PATENT DOCUMENTS

| | | | |
|---|---|---|---|
| D585,166 | S | 1/2009 | Strutt et al. |
| D605,370 | S | 12/2009 | Kellogg |
| D625,588 | S | 10/2010 | Norris et al. |
| D630,810 | S | 1/2011 | Bruneel |
| D637,779 | S | 5/2011 | Bruneel |
| D644,799 | S | 9/2011 | Bruneel |
| D653,938 | S | 2/2012 | Bergkvist |
| D659,309 | S | 5/2012 | Benacquisto et al. |
| D691,336 | S | 10/2013 | Griffin et al. |
| 8,997,293 | B2 | 4/2015 | Pichon et al. |
| D728,737 | S | 5/2015 | Mueller et al. |
| D738,713 | S | 9/2015 | Volin |
| D746,522 | S | 12/2015 | Erlich et al. |
| D756,208 | S | 5/2016 | Downs |
| D756,211 | S | 5/2016 | Downs |
| D757,533 | S | 5/2016 | Ormsbee et al. |
| D758,835 | S | 6/2016 | Vail et al. |
| D759,476 | S | 6/2016 | Yamashita et al. |
| D760,977 | S | 7/2016 | Van der Meijden et al. |
| D760,978 | S | 7/2016 | Van der Meijden et al. |
| D762,031 | S | 7/2016 | Niedzwecki |
| D773,765 | S | 12/2016 | Van der Meijden et al. |
| 2005/0198751 | A1 | 9/2005 | Navratil et al. |
| 2011/0000036 | A1 | 1/2011 | Pichon et al. |
| 2011/0314617 | A1 | 12/2011 | Van Der Meijden et al. |
| 2014/0165307 | A1 | 6/2014 | Hui et al. |
| 2014/0310894 | A1 | 10/2014 | van der Meijden et al. |
| 2015/0128361 | A1* | 5/2015 | Erlich ..... E04H 4/1636 15/1.7 |
| 2016/0025101 | A1 | 1/2016 | Tadokoro et al. |
| 2016/0025107 | A1 | 1/2016 | Pettitt |
| 2016/0032729 | A1 | 2/2016 | Turner |
| 2016/0053617 | A1 | 2/2016 | Grelotti et al. |
| 2016/0060887 | A1 | 3/2016 | Tryber et al. |

FOREIGN PATENT DOCUMENTS

| | | |
|---|---|---|
| GB | 2184647 | 7/1987 |
| WO | 2008096325 | 8/2008 |

OTHER PUBLICATIONS

Design U.S. Appl. No. 29/526,824, Notice of Allowance, dated Mar. 21, 2016, 6 pages.

Design U.S. Appl. No. 29/526,867, Notice of Allowance, dated Mar. 21, 2016, 9 pages.

Design U.S. Appl. No. 29/550,843, Notice of Allowance, dated Aug. 22, 2016, 10 pages.

International Patent Application No. PCT/US2016/032302, International Search Report and Written Opinion, dated Jul. 27, 2016, 15 pages.

U.S. Appl. No. 15/591,250, Non Final Office Action, dated Jun. 15, 2017, 7 pages.

U.S. Appl. No. 29/550,982, Notice of Allowance, dated Jul. 18, 2017, 6 pages.

* cited by examiner

COMPONENTS OF AUTOMATIC POOL CLEANERS

FIELD OF THE INVENTION

This invention relates to automatic pool cleaners (APCs) configured to move autonomously within liquid-containing bodies such as swimming pools and spas and more particularly, although not necessarily exclusively, to components of APCs that frictionally contact surfaces of the pools and spas.

BACKGROUND OF THE INVENTION

Commonly-owned U.S. Patent Application Publication No. 2011/0314617 of van der Meijden, et al., discloses various components of APCs. Among components illustrated in the van der Meijden application are devices referenced as "scrubbers." As detailed in the van der Meijden application, an exemplary scrubber may include blades, a shaft, and optionally a gear.

> In use, [the] scrubber desirably rotates about [the] shaft so as to move water . . . toward [an] inlet of [a] body of [an] automatic pool cleaner. Such rotation may be caused by interaction of [the] gear with a corresponding gear or other device typically located within [the] body.

See van der Meijden, pp. 1-2, ¶ 0026 (numerals omitted). The rotation and evacuation of water entering the inlet additionally produces "down force" tending to enhance traction of the APC as it moves along a surface within a pool.

Also described in the van der Meijden application as another optional part of a scrubber is a "wear surface." If present, the wear surface may be located centrally among the blades of the scrubber and coaxial with the shaft. At least at times in use, the wear surface may contact a surface to be cleaned. See id., p. 2, ¶ 0028.

Even though the van der Meijden application contemplates frictional contact between the wear surface and surfaces of a pool or spa, additional scrubbing action may be desirable—at least at times—for cleaning purposes. Including brushes spaced from (i.e. not coaxial with) the shaft of a scrubber also may be advantageous, as may be utilizing bristles which contact a surface as the scrubber rotates about the shaft. Removably attaching the brushes to a scrubber further may be beneficial, as in such cases the brushes may be removed from the scrubber when not needed.

SUMMARY OF THE INVENTION

The present invention provides these types of brushes useful especially (although not necessarily exclusively) with the scrubbers and APCs of the types identified in the van der Meij den application. Brushes of the invention may clip to a hub of a scrubber so as to attach to, and detach from, the scrubber easily. The brushes also preferably flex when a scrubber rotates.

At least some versions of the brushes may include fingers having bristles protruding outward on either or both of opposed sides of the fingers. Prior to rotation of the scrubbers, the fingers nominally are generally perpendicular to the surface on which the associated APC rests. As scrubbers rotate, however, the fingers flex (e.g. lay over) and become more parallel to the surface. Flexing of the fingers in this manner in turn causes bristles on one side of fingers to become more perpendicular to the surface, thus readily frictionally contacting it.

Because in use scrubbers of the present invention rotate about an axis generally perpendicular to the pool surface, their brush speeds relative to the surface are faster than those of passive devices (which typically are dragged along the surface) or rollers (which typically rotate about an axis parallel to the surface and in the same direction as the wheels of the cleaner). Such rotation also requires less surface-area contact between the brushes and pool surface to scrub an equivalent width of pool surface than would a roller, whose length must span that entire width. This decreased surface-area contact of the brushes produces less resistance on the drive system of the APC than would rollers, potentially enhancing the longevity and robustness of the drive system.

Brushes may be attached as desired to a scrubber. Presently preferred is that at least two brushes be used with a scrubber and positioned symmetrically about the shaft. Fewer or more than two brushes may be used in connection with any particular scrubber, however, and conceivably more than one brush may be attached in a particular location.

It thus is an optional, non-exclusive object of the present invention to provide components for APCs.

It also is an optional, non-exclusive object of the present invention to provide improvements to scrubbers of the type identified in the van der Meij den application.

It is another optional, non-exclusive object of the present invention to provide brushes configured to contact to-be-cleaned surfaces.

It is an additional optional, non-exclusive object of the present invention to provide brushes that may clip, or otherwise attach, to scrubbers so as to rotate as the blades rotate.

It is, moreover, an optional, non-exclusive object of the present invention to provide brushes that include flexible fingers with bristles protruding therefrom.

It is a further optional, non-exclusive object of the present invention to provide brushes whose fingers flex as their associated blades rotate, thus causing contact between their bristles and a to-be-cleaned surface of a pool or spa.

It is yet another optional, non-exclusive object of the present invention to provide brushes which rotate about an axis perpendicular to the to-be-cleaned surface so as to produce faster speeds and less load on drive systems than do certain passive devices and rollers.

Other objects, features, and advantages of the present invention will be apparent to those skilled in relevant fields with reference to the remaining text and the drawings of this application.

DETAILED DESCRIPTION

Figure 1A:
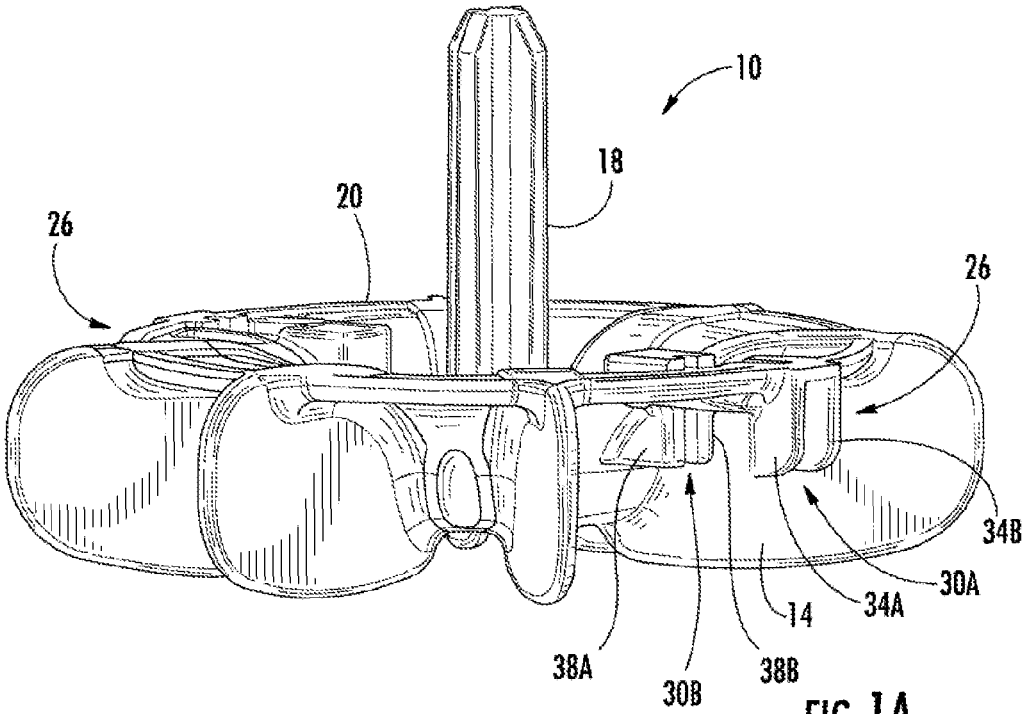
FIG. 1A is an elevational view of an exemplary scrubber similar to that of those of the van der Meijden application.
Figure 1B:
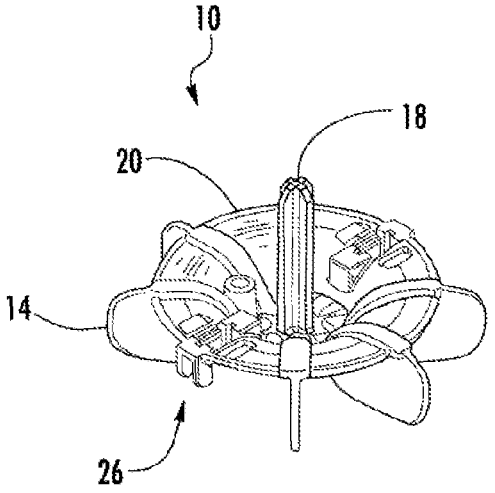
FIG. 1B is a perspective view of the scrubber of FIG. 1A.

Depicted in FIGS. 1A-B is exemplary scrubber 10. Scrubber 10, which is generally similar to scrubbers of the van der Meij den application, may include blades 14 and shaft 18.

Also illustrated in FIGS. 1A-B is hub 20 interconnecting blades 14 and shaft 18. In use, scrubber 10 desirably rotates about shaft 18 so as to move water toward an inlet 21 of a cleaner such as APC 22 (see FIG. 5). When the APC 22 is upright on a bottom surface of a pool, shaft 18 will be generally perpendicular to the plane of the bottom surface and thus scrubber 10 will rotate about an axis perpendicular (or generally so) to the bottom surface.

Consistent with the discussion in the van der Meijden application, blades 14 preferably are "semi-rigid" in nature, meaning that they have sufficient flexibility to accommodate passage into inlet 21 of APC 22, without blockage, of at least some larger types of debris often found in outdoor swimming pools. The term "semi-rigid" also means that blades 14 nevertheless have sufficient rigidity to move volumes of water toward the inlet 21 of the cleaner as they rotate about shaft 18. A presently-preferred material from which blades 14 is made remains molded thermoplastic polyurethane, although other materials may be used instead.

Figure 5:
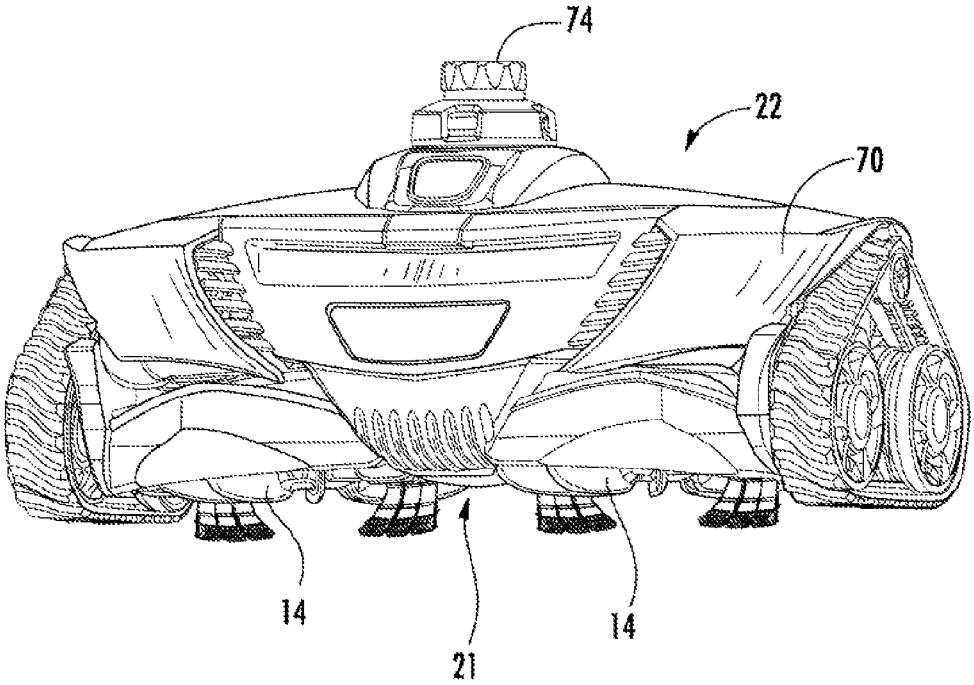
FIG. 5 is a perspective view of an APC including two scrubbers, to each of which brushes have been attached in a manner similar to FIG. 3.

Scrubber 10 advantageously may include six blades 14 extending radially from shaft 18. Fewer or greater numbers of blades 14 may be employed as appropriate, however. As illustrated in FIG. 5, two scrubbers 10 preferably are employed as part of APC 22, with each scrubber 10 being positioned at least partly to a side of inlet 21 of the APC 22. Again, though, fewer or greater numbers of scrubbers 10 may be utilized, and each or any scrubber 10 may be positioned in any suitable location.

As shown in FIG. 1A, many of the six blades 14 are circumferentially spaced approximately forty-five degrees, rather than approximately sixty degrees, from adjacent blades 14. This is because attachment assemblies 26 of hub 20 have, in effect, replaced the seventh and eighth blades. The two attachment assemblies 26 are at least partially visible in FIG. 1A spaced circumferentially about shaft 18 by approximately one hundred eighty degrees. Symmetrical positioning of attachment assemblies 26 about shaft 18 presently is preferred, although situations may arise in which an odd number of assemblies 26, or asymmetrical positioning of an even number of assemblies 26, is desired.

The exemplary attachment assembly 26 of FIG. 1A may comprise at least one recess 30A. In the version of scrubber 10 depicted in FIG. 1A, recess 30A is formed by a pair of spaced walls 34A-B connected to hub 20. A second recess 30B, formed by a pair of spaced walls 38A-B connected to hub 20, also appears in FIG. 1A.

Figure 2A:
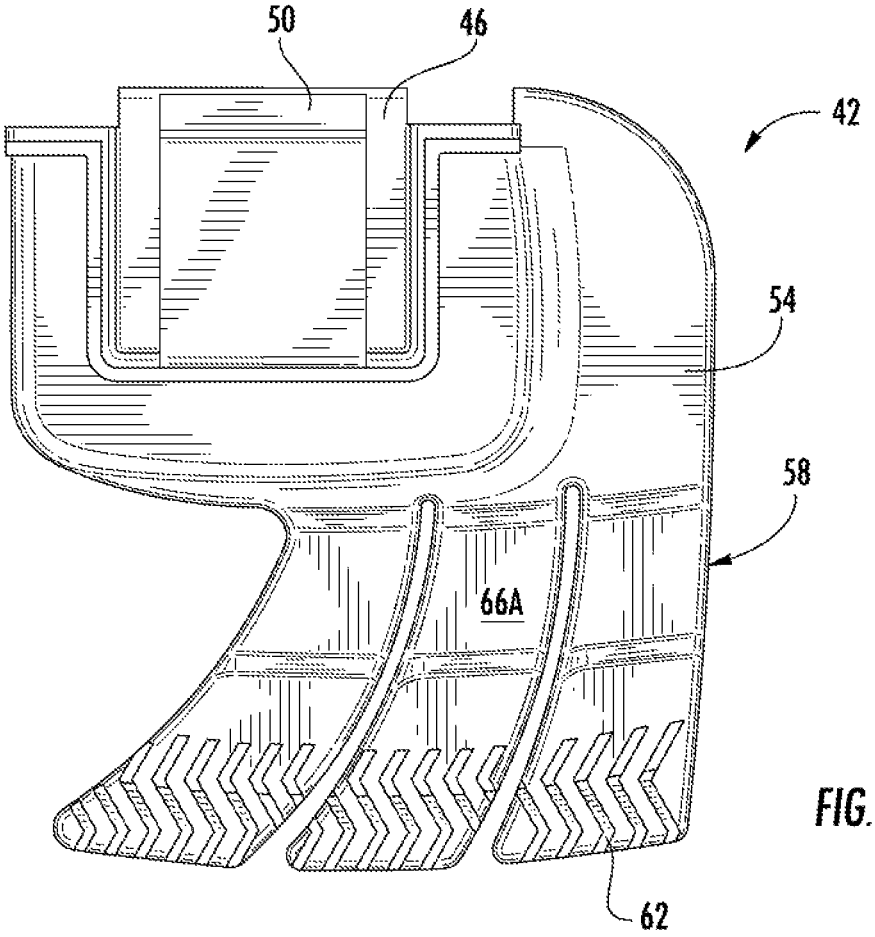
FIGS. 2A-C are various views of an exemplary brush configured to attach to the scrubber of FIG. 1A.
Figure 2B:
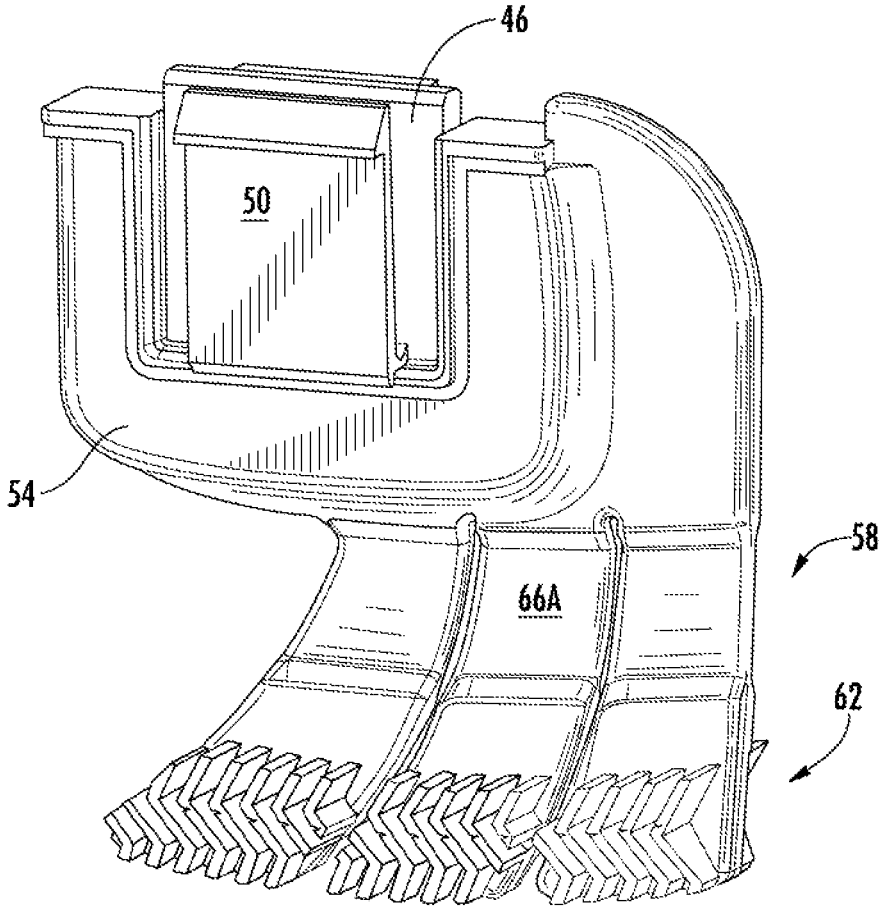
Figure 2C:
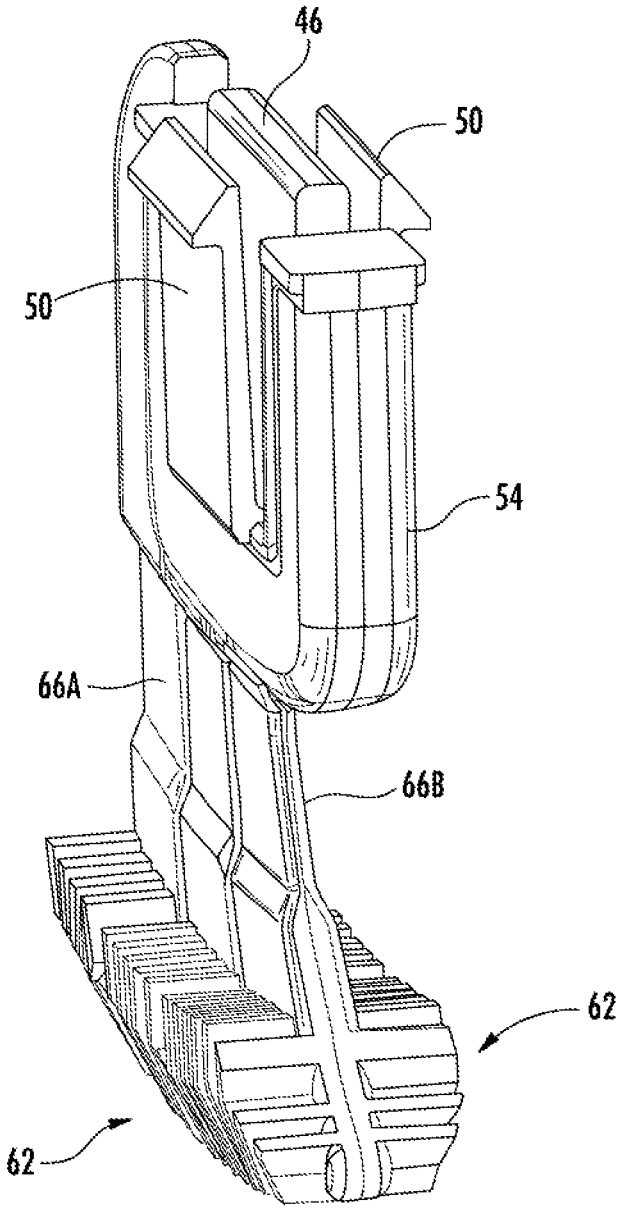
Figure 3:
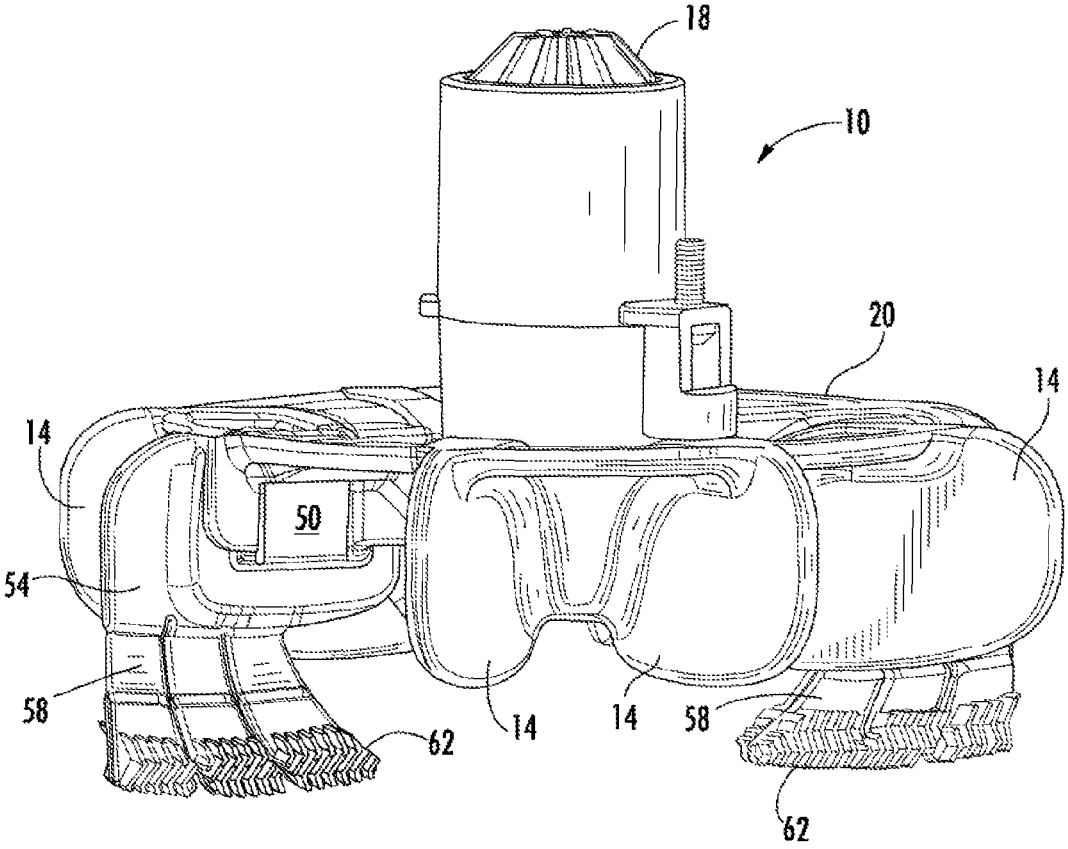
FIG. 3 is an elevational view of the scrubber of FIG. 1A to which two brushes of FIGS. 2A-C have been attached.
Figure 4:
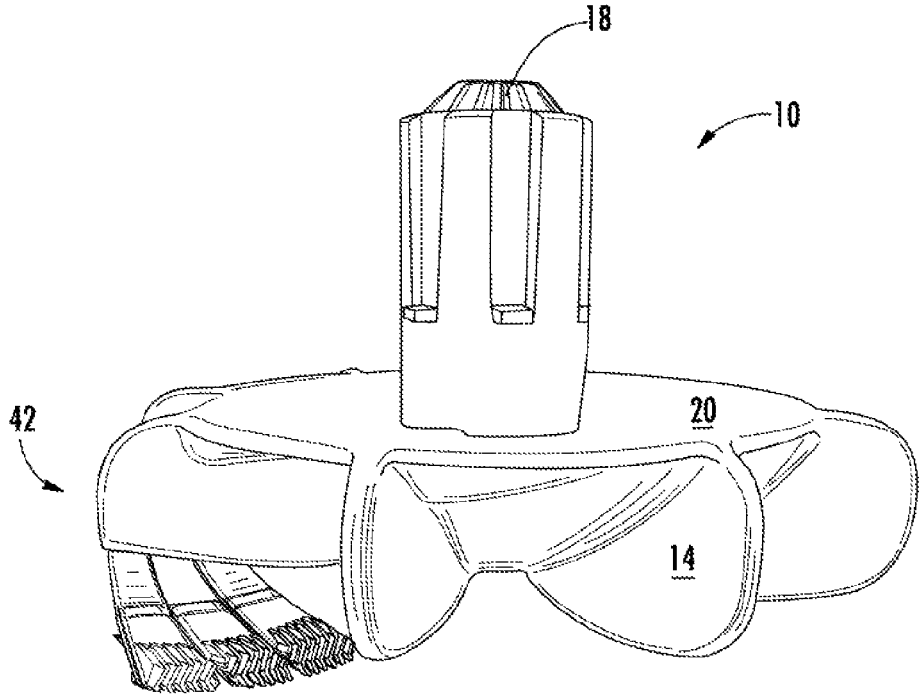
FIG. 4 is a perspective view of the scrubber of FIG. 1A to which one brush of FIGS. 2A-C has been attached for purposes of showing its flexibility.

Shown especially in FIGS. 2A-C is exemplary brush 42. Included as part of brush 42 is member 46, which is sized and shaped to be frictionally fitted into recesses 30A and 30B. Concurrently, clips 50 of brush 42 frictionally slide along walls 34A-B and 38A-B. Manipulating brush 42 in this manner connects the brush 42 to scrubber 10 for use—as shown in FIGS. 3-5. Because brush 42 is likely to wear through use, it preferably may be detached from scrubber 42 (as through manual force, for example) for replacement.

Also included as parts of brush 42 are brush body 54, fingers 58, and bristles 62. Fingers 58 depend from body 54, with each finger 58 comprising opposed major sides 66A-B. Bristles 52 protrude outward from these major sides 66A-B. Although FIGS. 2A-5 illustrate three fingers 58 depending from each body 54, more or fewer fingers 58 may be present instead if appropriate or desired.

Fingers 58 beneficially are flexible. Accordingly, as shown in FIG. 4, fingers 58 may flex as blades 14 rotate about shaft 18. Whereas major sides 66A-B are nominally vertical when APC is upright (e.g. FIG. 5) and blades 14 are not rotating, flexing of fingers 58 causes major sides 66A-B to become more closely parallel to the surface to be cleaned. Consequently, because bristles 52 protrude outward from major sides 66A-B, these bristles 52 become more closely perpendicular to the to-be-cleaned surface as the fingers 58 flex. Bristles 52 thus in use may contact the to-be-cleaned surface so as to "scrub" the surface and suspend bottom-dwelling debris into the water of the pool for evacuation into inlet 21 of APC 22. Consistent with other suction-type APCs, APC 22 also may include body 70 through which the evacuated water may flow to outlet 74 and then into a hose, all under influence of a pump.

Moreover, because scrubber 10 rotates about an axis perpendicular to the to-be-cleaned surface, the speed of movement of brushes 42 (and hence of bristles 52) relative to the surface may be faster than that of passive devices which merely are dragged along the surface. This relative speed of movement likewise may be faster than that of rollers, which typically rotate about axes parallel to the surface and in the same direction as the wheels or tracks of an associated cleaner. Rotation of scrubber 10 about the perpendicular axis also requires approximately fifty percent less surface-area contact between brushes 42 and the pool surface to scrub an equivalent width of pool surface than would a roller, whose length must span that entire width. This decreased surface-area contact of brushes 42 produces less resistance on the drive system of APC 22 than would rollers, potentially enhancing the longevity and robustness of the drive system.

If scrubber 10 is configured to rotate only in one direction, bristles 52 need necessarily be present only on whichever of major sides 66A or 66B is the "leading" side for purpose of the rotation (as the other, "trailing" major side will flex away from the to-be-cleaned surface). It nevertheless may be advantageous to include bristles 52 on the trailing major side 66B or 66A of brush 42 so that, when bristles 52 on the leading side wear, brush 42 may be switched to a circumferentially opposite location on scrubber 10 so that the previously-trailing side becomes the leading side and presents unworn bristles 52 to the to-be-cleaned surface. This switch effectively can double the useful life of a brush 42. (And of course, if scrubber 10 ever is configured to rotate both clockwise and counterclockwise, including bristles 52 on both major sides 66A-B may be valuable.)

The foregoing is provided for purposes of illustrating, explaining, and describing embodiments of the present invention. Modifications and adaptations to these embodiments will be apparent to those skilled in the art and may be made without departing from the scope or spirit of the invention. Also, although "pool" and "spa" are sometimes used separately, any reference to "pool" herein may include a spa, hot tub, or other vessel in which water is placed for swimming, bathing, therapy, or recreation. Finally, incorporated herein in their entirety by this reference are the contents of the van der Meij den application.

What is claimed is:

1. An automatic pool cleaner comprising:

a. a body (i) configured to travel autonomously along a surface of a pool to be cleaned and (ii) comprising an inlet for receiving water of the pool; and b. a down-force scrubber comprising:

i. a shaft positioned at least partially within the body so as to be generally perpendicular to the surface as the body travels therealong;

ii. a hub having a circumference;

iii. a first brush (A) displaced radially from the shaft about the circumference of the hub, (B) configured to rotate about the shaft, and (C) configured to contact the surface as the body travels therealong; and iv. a blade (A) configured to rotate about the shaft and (B) circumferentially displaced from the first brush about the circumference of the hub.

2. An automatic pool cleaner according comprising:

a. a body configured to travel along a surface to be cleaned;

b. a shaft positioned at least partially within the body so as to be generally perpendicular to the surface as the body travels therealong;

c. a first brush (i) displaced radially from the shaft, (ii) configured to rotate about the shaft, (iii) configured to contact the surface as the body travels therealong, and (iv) comprising:

A. a brush body;

B. a finger depending from the brush body and comprising opposed first and second major sides; and C. bristles protruding outward from the first major side; and d. a blade (i) configured to rotate about the shaft and (ii) circumferentially displaced from the first brush.

3. An automatic pool cleaner according to claim 2 in which the first brush further comprises bristles protruding outward from the second major side.

4. An automatic pool cleaner according to claim 3 in which the shaft and the blade are parts of a scrubber also comprising a hub interconnecting the shaft and the blade.

5. An automatic pool cleaner according to claim 4 in which the hub comprises an attachment assembly configured to receive the first brush.

6. An automatic pool cleaner according to claim 5 in which (i) the attachment assembly comprises a first recess, (ii) the first brush comprises a member, and (iii) the member is frictionally fitted into the recess to attach the first brush to the hub.

7. An automatic pool cleaner according to claim 6 in which the member is detachable from the recess.

8. An automatic pool cleaner according to claim 7 in which the finger is flexible.

9. An automatic pool cleaner according to claim 8 further comprising a second brush (i) displaced radially from the shaft, (ii) configured to rotate about the shaft, (iii) configured to contact the surface as the body travels therealong, and (iv) circumferentially spaced from the first brush.

10. An automatic pool cleaner according to claim 9 in which the second brush is circumferentially opposed to the first brush.

11. An automatic pool cleaner according to claim 2 in which the bristles comprise at least one pair of generally parallel sections protruding outward from the first major side.

* * * * *